US008602602B2

(12) United States Patent
Anaokar et al.

(10) Patent No.: US 8,602,602 B2
(45) Date of Patent: Dec. 10, 2013

(54) LED DOWNLIGHT WITH IMPROVED LIGHT OUTPUT

(75) Inventors: Smita Anaokar, Smyrna, GA (US); Robert Allan Blalock, Peachtree City, GA (US); George Michael Drake, Newnan, GA (US); Adam Moore Foy, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 157 days.

(21) Appl. No.: 13/007,398

(22) Filed: Jan. 14, 2011

(65) Prior Publication Data

US 2011/0170298 A1 Jul. 14, 2011

Related U.S. Application Data

(60) Provisional application No. 61/295,044, filed on Jan. 14, 2010.

(51) Int. Cl.

| | |
|---|---|
| ***F21V 7/00*** | (2006.01) |
| ***F21V 15/00*** | (2006.01) |
| ***F21V 17/00*** | (2006.01) |
| ***F21S 8/00*** | (2006.01) |

(52) U.S. Cl.
USPC ..... 362/297; 362/364; 362/147; 362/150

(58) Field of Classification Search
USPC ..... 362/297, 364–366, 147, 148, 150
See application file for complete search history.

(56) References Cited

U.S. PATENT DOCUMENTS

| | | | | |
|---|---|---|---|---|
| 3,721,817 | A | 3/1973 | Contratto | |
| 5,124,901 | A | 6/1992 | Sojka et al. | |
| 5,826,970 | A * | 10/1998 | Keller et al. | 362/147 |
| 5,957,574 | A | 9/1999 | Hentz et al. | |
| 6,431,723 | B1 * | 8/2002 | Schubert et al. | 362/147 |
| 7,722,227 | B2 | 5/2010 | Zhang et al. | |
| 7,993,034 | B2 | 8/2011 | Wegner | |
| 8,042,973 | B2 * | 10/2011 | Inoue et al. | 362/311.02 |
| 8,070,328 | B1 * | 12/2011 | Knoble et al. | 362/311.02 |
| 8,096,670 | B2 * | 1/2012 | Trott et al. | 362/147 |
| 8,182,116 | B2 | 5/2012 | Zhang et al. | |
| 8,220,970 | B1 * | 7/2012 | Khazi et al. | 362/294 |
| 8,287,142 | B2 | 10/2012 | Pickard et al. | |

(Continued)

OTHER PUBLICATIONS

Juno Lighting Group, Indy J3.1.19, Product Specifications, 6" Square PAR38 Internally Adjustable, Aug. 2009.

(Continued)

*Primary Examiner* — David J Makiya

(74) *Attorney, Agent, or Firm* — King & Spalding LLP

(57) ABSTRACT

An LED downlight provides a more evenly distributed light output. The LED downlight includes an LED light source, such as one or more LEDs, LED die packages, or LED chip on board modules, an upper reflector, a lower reflector disposed below the upper reflector, and a lens disposed between the upper reflector and the lower reflector. The lens includes several features that help disperse light emitted by the LED light source. The lens includes a diffusion element, such as a pigment, bulk scattering, prismatic, inlays, or another method for diffusing light through a lens. The lens is curved in a concave manner when viewed from the light source. The curve of the lens can be tangent to the physical cutoff of the lower reflector to more evenly distribute light emitted by the LED light source and to improve the visual effect of an evenly luminous lens.

26 Claims, 8 Drawing Sheets

(56) References Cited

U.S. PATENT DOCUMENTS

| | | | | |
|---|---|---|---|---|
| 2003/0053315 | A1 | 3/2003 | Chen | |
| 2005/0168986 | A1* | 8/2005 | Wegner | 362/241 |
| 2005/0254241 | A1 | 11/2005 | Harwood | |
| 2007/0097693 | A1* | 5/2007 | Klose | 362/307 |
| 2008/0084701 | A1* | 4/2008 | Van De Ven et al. | 362/373 |
| 2008/0165535 | A1 | 7/2008 | Mazzochette | |
| 2009/0129086 | A1 | 5/2009 | Thompson, III | |
| 2009/0231862 | A1 | 9/2009 | Seo | |
| 2010/0188838 | A1* | 7/2010 | Yajima et al. | 362/84 |

OTHER PUBLICATIONS

Prescolite, LiteFrame LED, LiteFrame 6" LED downlight; Product Specification, Sep. 2010.
Philips Lighting, Product Specification, eW Downlight Powercore, Feb. 2010.
Renaissance Lighting, Product Specification, Solia 4" White Downlight Square, Oct. 2010.
Cree Lighting, Product Brochure, Power Optic, LED-Tech. DE Optoelectronics.
International Search Report issued for PCT/US2011/021390 mailed on Aug. 31, 2011.0

* cited by examiner

LED DOWNLIGHT WITH IMPROVED LIGHT OUTPUT

RELATED PATENT APPLICATIONS

This patent application claims priority under 35 U.S.C. §119 to U.S. Provisional Patent Application No. 61/295,044, titled "Features for Improving Installation and Light Output for LED Lighting Fixtures" and filed Jan. 14, 2010, the complete disclosure of which is hereby fully incorporated herein by reference.

TECHNICAL FIELD

The technical field relates generally to light emitting diode ("LED") downlights, and more particularly to an LED downlight having a curved lens and additional features for improving light output from the LED downlight.

BACKGROUND

Downlights are light fixtures that are installed in a hollow opening within a ceiling to provide inconspicuous light that appears to shine from a hole in the ceiling. The downlight generally includes a housing mounted in the ceiling and a lighting module removably attachable to the housing. The lighting module generally includes a light source, such as one or more LEDs, compact fluorescent lamps ("CFLs"), high-intensity discharge ("HID") lamps, or incandescent lamps.

Downlights sometimes employ small, very bright light sources. These tiny, bright light sources should be diffused to the viewer while being efficient and not sacrificing a large portion of the light output. Flat glass lenses have been used in downlights in the past to diffuse the light sources, particularly with HID light sources. These flat glass lenses typically utilize prismatic elements on either side of the lens that diffuse the light source. However, the light diffusion provided by flat lenses fails to provide adequate uniform luminance as the light transmitted by flat lenses is generally significantly more intense near the center of the lens than at outer points of the lens.

SUMMARY

The present invention provides a light emitting diode ("LED") downlight having improved light output. The LED downlight can include an LED light source, such as one or more LEDs, LED die packages, or LED chip on board modules. The LED downlight also can include an upper reflector, a lower reflector disposed below the upper reflector, and a lens disposed between the upper reflector and the lower reflector. The upper reflector can be disposed about the LED light source and extend in a curvilinear manner downward to a bottom edge from the LED light source. The upper reflector can include a white reflective surface that is curved in a convex manner when viewed from the light output area of the lower reflector. The lower reflector can include a defocused parabolic reflector, a truncated cone reflector, a frustum-shaped cone reflector, other shaped reflector.

The lens includes several features that helps disperse light emitted by the LED light source. The lens can include a diffusion element, such as a pigment, bulk scattering, prismatic, inlays, or another method for diffusing light through a lens. The lens can be curved in a concave manner when viewed from the light source. The curve of the lens can be tangent to the physical cutoff of the lower reflector to improve the visual effect of an evenly luminous lens.

The LED downlight also can include a mechanism for preventing light from leaking between the upper reflector and the lens. A rib can be added to the outer perimeter of the upper reflector to block light that is emitting from the end of the lens. The rib can be constructed of the same or a different material as that of the upper reflector. A gasket or gasket molded plastic ring can be placed around the outer perimeter of the lens or the upper reflector. The outer perimeter of the lens can be masked using paint or an L-shaped gasket.

For one aspect of the present invention, an LED downlight can include an LED light source. An upper reflector can be disposed about a perimeter of the LED light source and extend in a curvilinear manner downward to a bottom edge from the LED light source. A lower reflector can be disposed below the upper reflector. A lens can be disposed between the upper reflector and the lower reflector and comprising an outer perimeter and a curved surface disposed within the outer perimeter. The curved surface can include a vertex disposed substantially in front of the LED light source.

For another aspect of the invention, a light fixture can include a light source. An upper reflector can be disposed about a lateral edge of the light source and have at least a portion extending in a curvilinear manner downward to a bottom edge from the light source. A lower reflector can be disposed below the upper reflector. A lens can have at least a portion disposed between the upper reflector and the lower reflector and include an outer perimeter disposed between portions of the upper reflector and the lower reflector. A light leak prevention device can be disposed along an outside of the outer perimeter of the lens for preventing light emitted by the light source from exiting the lens through the outer perimeter.

For yet another aspect of the present invention, a downlight luminaire can include an LED light source. An upper reflector can be disposed circumferentially about the LED light source and extend in a curvilinear manner downward to a bottom edge from the LED light source. The upper reflector can include a curved shape convex to the LED light source. A lower reflector can be disposed below the upper reflector and have a substantially conical shape. A lens can be disposed between the upper reflector and the lower reflector. The lens can include a circular outer perimeter, a curved shape concave to the LED light source, and a diffusion element. A portion of the curvature of the lens can be tangent to a physical cutoff of the lower reflector. The physical cutoff can be defined by a line that extends from a point on a top perimeter of the lower reflector to a point on a bottom perimeter of the lower reflector. The point on the top perimeter and the point on the bottom perimeter can be on opposite sides of the lower reflector.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
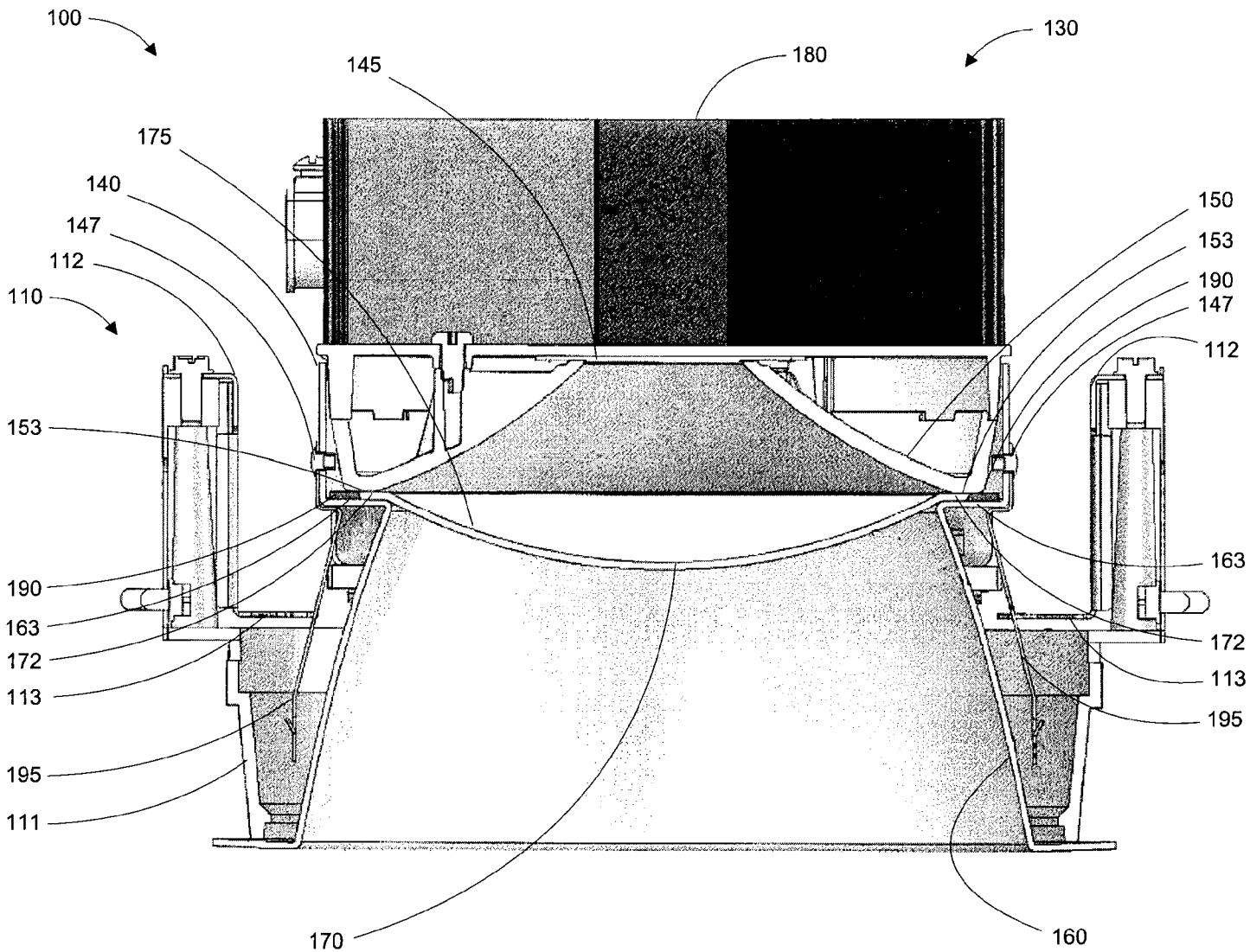
FIG. 1 is a cross-sectional view of a light emitting diode ("LED") downlight, in accordance with certain exemplary embodiments.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles.

DETAILED DESCRIPTION OF EXEMPLARY EMBODIMENTS

Embodiments of the invention are directed to downlights having improved light output. The downlight can include a light source, such as one or more LEDs, LED die packages, LED chip on board modules, CFLs, HID lamps, or incandescent lamps. The downlight also can include an upper reflector, a lower reflector disposed below the upper reflector, and a lens disposed between the upper reflector and the lower reflector. The lens includes one or more features that helps disperse light emitted by the light source. In one exemplary embodiment, the lens can include a diffusion element, such as a pigment, bulk scattering, prismatic, inlays, or another method for diffusing light through a lens. In another embodiment, the lens can be curved, for example in a concave manner when viewed from the light source. The curve of the lens can be tangent to the physical cutoff of the lower reflector to improve the visual effect of an evenly luminous lens.

The following description of exemplary embodiments refers to the attached drawings. Any spatial references herein such as, for example, "upper," "lower," "above," "below," "rear," "between," "vertical," "angular," "beneath," etc., are for the purpose of illustration only and do not limit the specific orientation or location of the described structure.

Figure 2:
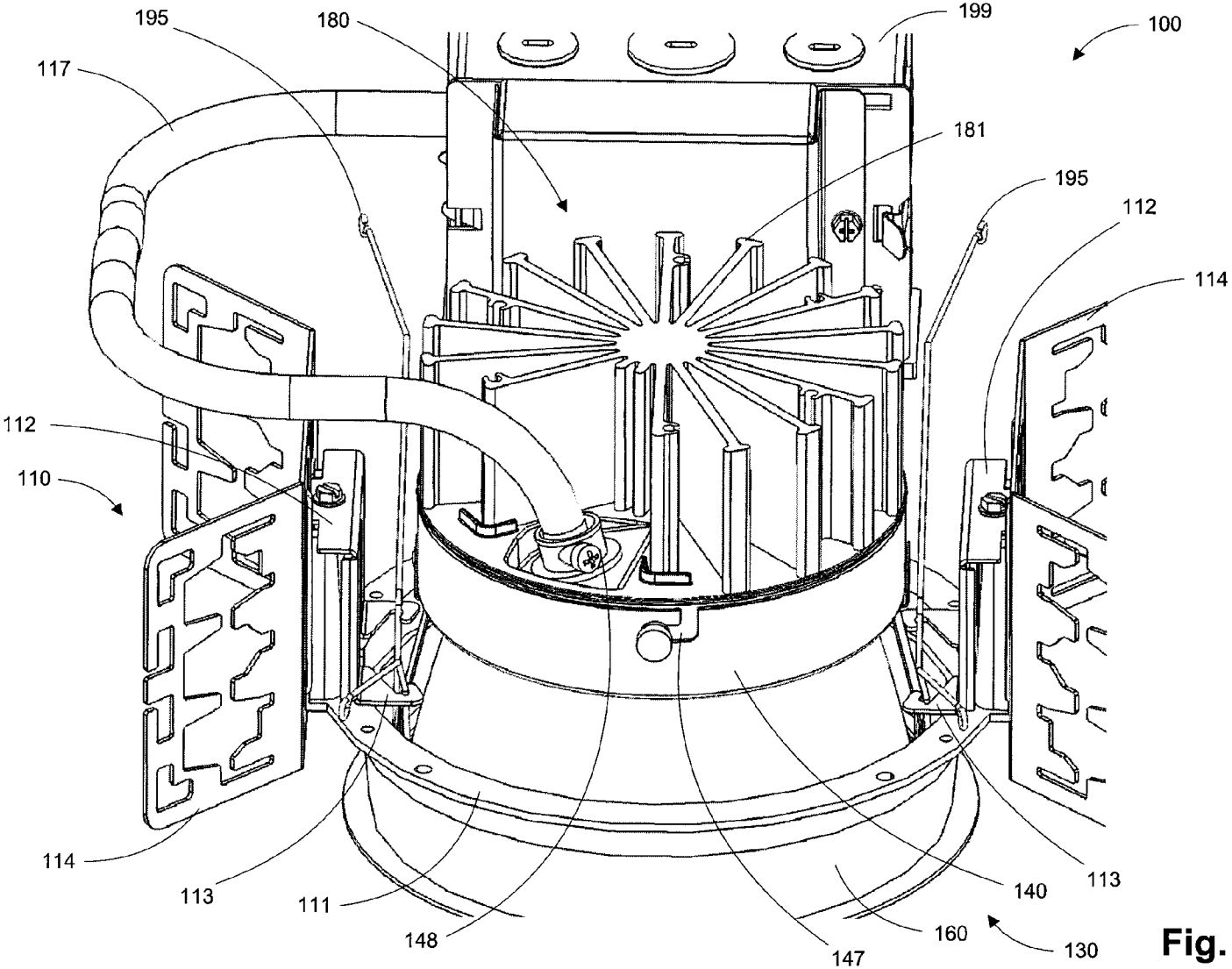
FIG. 2 is a partial perspective view of the LED downlight of FIG. 1, in accordance with certain exemplary embodiments.

Referring now to the figures, in which like numerals represent like (but not necessarily identical) elements throughout the figures, exemplary embodiments of the present invention are described in detail. FIGS. 1 and 2 depict an LED downlight 100, in accordance with certain exemplary embodiments. In particular, FIG. 1 is a cross-sectional view of the exemplary LED downlight 100 and FIG. 2 is a partial perspective view of the exemplary LED downlight 100.

Referring to FIGS. 1 and 2, the exemplary LED downlight 100 includes a housing 110 and an LED lighting module 130 removably attachable to the housing 110. The housing 110 includes a lamp holder 111 that forms an aperture for receiving the LED lighting module 130. The housing 110 also includes two mounting brackets 112 attached to the lamp holder 111, typically at substantially opposite lateral sides of the lamp holder 111. Each mounting bracket 112 also is attached to a frame 114 that is typically attached to a support structure (not shown) to hold the housing 110 in place. In one example, the housing 110 is installed in a hollow space within a ceiling by attaching the frame 114 to a ceiling joist support structure. Each mounting bracket 112 also includes a torsion spring receiver 113. The torsion spring receiver 113 of each mounting bracket 112 is configured to receive and hold in place a respective torsion spring 195 of the LED lighting module 130. By holding the torsions spring 195 in place, the torsion spring receiver 113 holds the LED lighting module 130 in place in the housing 110.

The LED lighting module 130 includes a light source housing 140 that houses an LED light source 145, such as one or more LEDs, organic LEDs ("OLEDs"), LED die packages, or LED chip on board modules. The LED lighting module 130 also includes an upper reflector 150 disposed in the light source housing 140, a lower reflector 160 disposed below the upper reflector 150, and a lens 170 disposed between the upper reflector 150 and the lower reflector 160. In certain exemplary embodiments, the upper reflector 150 and lower reflector 160 are a single, integrated unit disposed above and below the lens 170. The LED light source 145 is arranged in the light source housing 140 to emit light downward through the lens 170 and ultimately out of an opening defined by the lower reflector 160. In certain exemplary embodiments, the light source housing 140 and the lower reflector 150 are fabricated as a single, integrated unit. In certain exemplary embodiments, the upper housing 140 is mounted to the lower reflector 160, for example using adhesives, screws, or another attachment device.

A flexible conduit 117 routes electrical wires or cables to the LED light source 145 from an another device 199, such as a power supply or driver. The flexible conduit 117 is connected to a flexible conduit connector 148 disposed on an upper surface of the light source housing 140. The flexible conduit connector 148 includes at least one aperture that extends from its top side through to its bottom side inside the light source housing 140. This aperture provides a pathway for electrical connections between the wires or cables outside the light source housing 140 to access the inner portion of the light source housing 140.

The LED lighting module 130 also includes a heat sink 180 disposed above the light source housing 140. The heat sink 180 dissipates heat generated by the LED light source 145. The heat sink 180 is configured and sized accordingly to disperse a sufficient amount of heat based on the LED light source 145. The heat sink 180 is capable of being fabricated from aluminum or any other suitable material known to one of ordinary skill in the art. In the illustrated embodiment, the heat sink 180 includes a multitude of heat sink fins 181 extending radially from a central core extending up from the upper surface of the light source housing 140. Other configurations of heat sinks 180 are also feasible without departing from the scope and spirit of the present invention.

The upper reflector 150 includes an inner reflective surface that surrounds the LED light source 145 and extends in a curvilinear manner downward to a bottom edge 153 from the LED light source 145. In certain exemplary embodiments, the upper reflector 150 is disposed circumferentially about the LED light source 145. The reflective surface is fabricated or coated with a highly reflective material. In certain exemplary embodiments, the reflective surface is coated with a highly reflective white paint. A diffuse white reflective material provides better lit appearance of the LED lighting module 130 than a specular reflector.

The upper reflector 150 acts as a mixing cavity for light reflected off of the lens 170, efficiently reflecting the light out of the LED lighting module 130. The reflective surface of the upper reflector 150 is curved in a convex manner when viewed from the light output area defined by the lower reflector 160. The curved configuration of the upper reflector 150 provides improved reflection of the light incident on the reflective surface from the lens 170 by directing incident light back towards the lens 170 at a lower angle of incidence resulting in more light passing through the lens 170 rather than reflecting back off the lens 170 to the upper reflector 150.

The angle of incidence is the angle between a ray of light incident on the surface of the lens 170 (or another object) and the line perpendicular to the surface of the lens 170 at the point of incidence. The line perpendicular to the surface of the lens 170 at the point of incidence is called the normal. A portion of light incident on the lens 170 at an angle of incidence other than the normal will reflect from the lens 170 rather than passing through the lens 170. The amount of light reflected by the lens 170 is directly proportional to the angle of incidence. Thus, reducing the angle of incidence for light incident on the lens 170 allows more light to pass through the lens 170.

Figure 3:
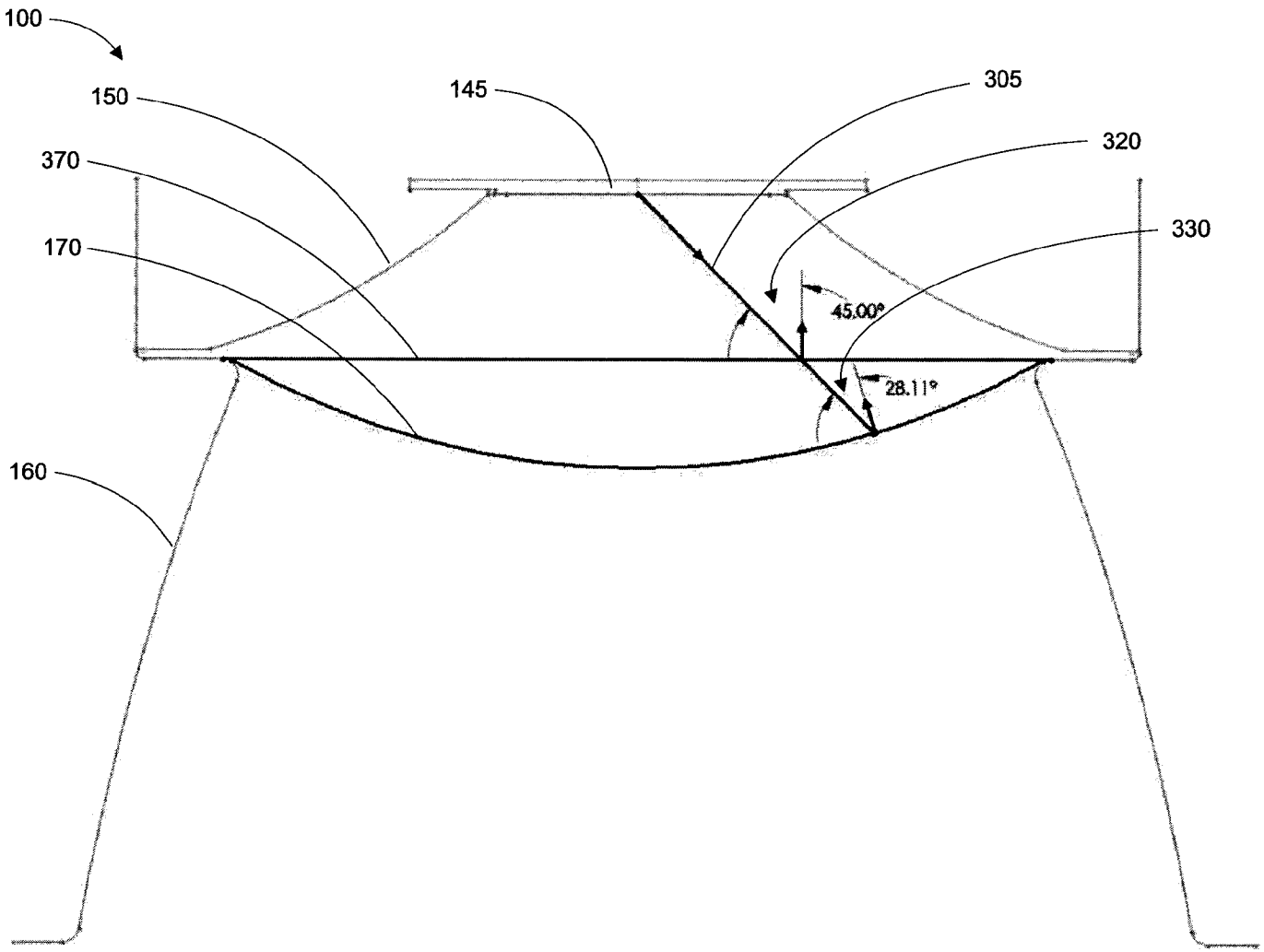
FIG. 3 depicts a comparison of angles of incident of light reflected off of a curved lens and light reflected off of a flat-shaped lens, in accordance with certain exemplary embodiments.

FIG. 3 depicts a comparison of angles of incident of light reflected off of the curved lens 170 and light reflected off of a flat-shaped lens 370, in accordance with certain exemplary embodiments. FIG. 3 depicts an example of one of the benefits of using the curved lens 170 rather than the flat lens 370. In particular, the use of a curved lens 170 results in a reduction in the fresnel losses compared to that of the flat-shaped lens 370. Referring to FIG. 3, light 305 emitted by the LED light source 145 at a 45° angle with respect to nadir approaches the lens 370 at an angle of incidence 330 of 45°. By comparison, the light 305 approaches the lens 170 at an angle of incidence 320 of 25.11°. Thus, the effect of using curved lens 170 rather than a flat-shaped lens 370 reduces the angle of incidence for light emitted by the LED light source 145 in a direction other than straight down. The reduction in the angle of incidence results in reduced fresnel losses and more light transmission through the lens 170.

Figure 7:
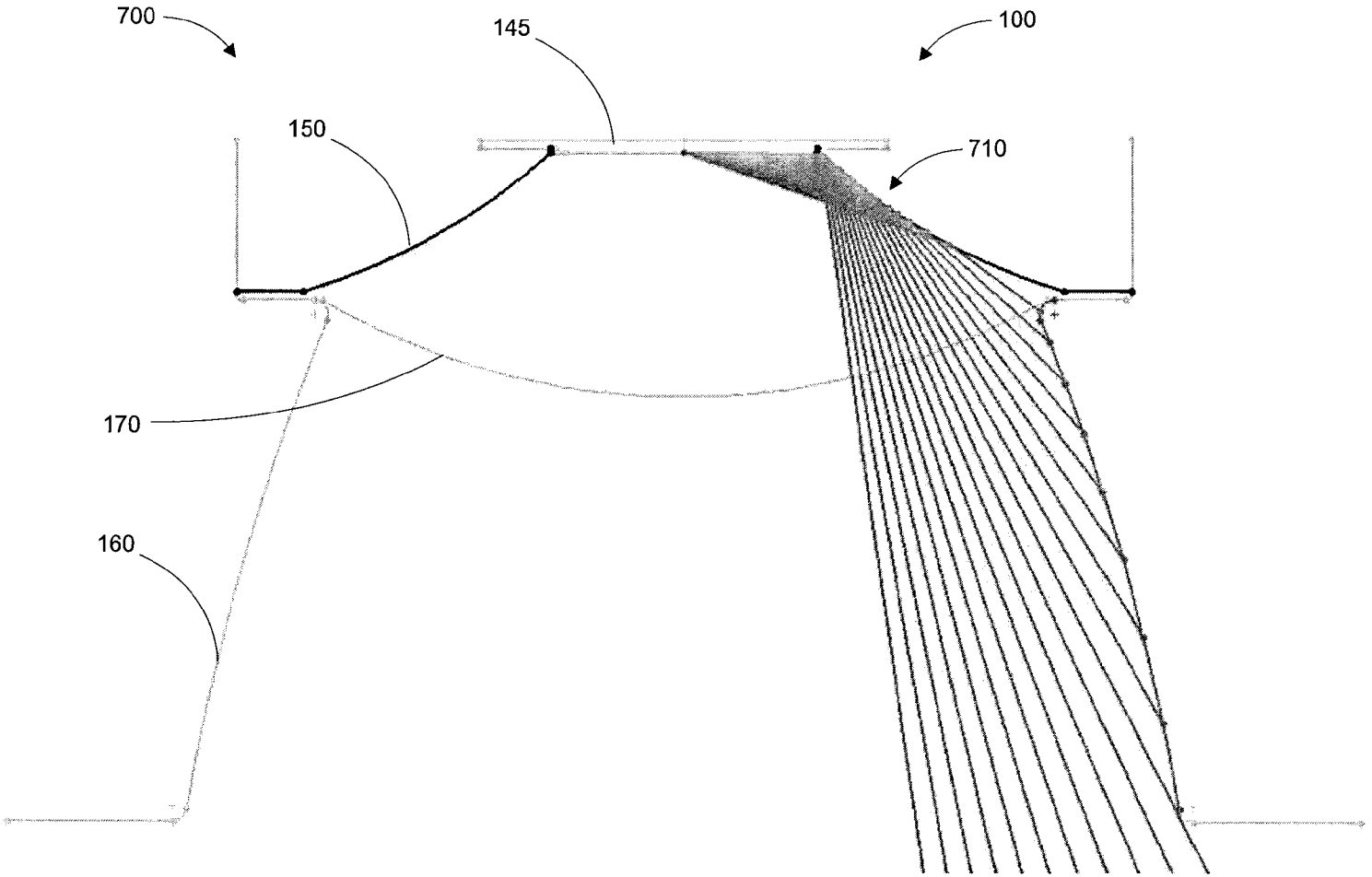
FIG. 7 depicts a raytrace for the LED downlight of FIG. 1, in accordance with certain exemplary embodiments.
Figure 8:
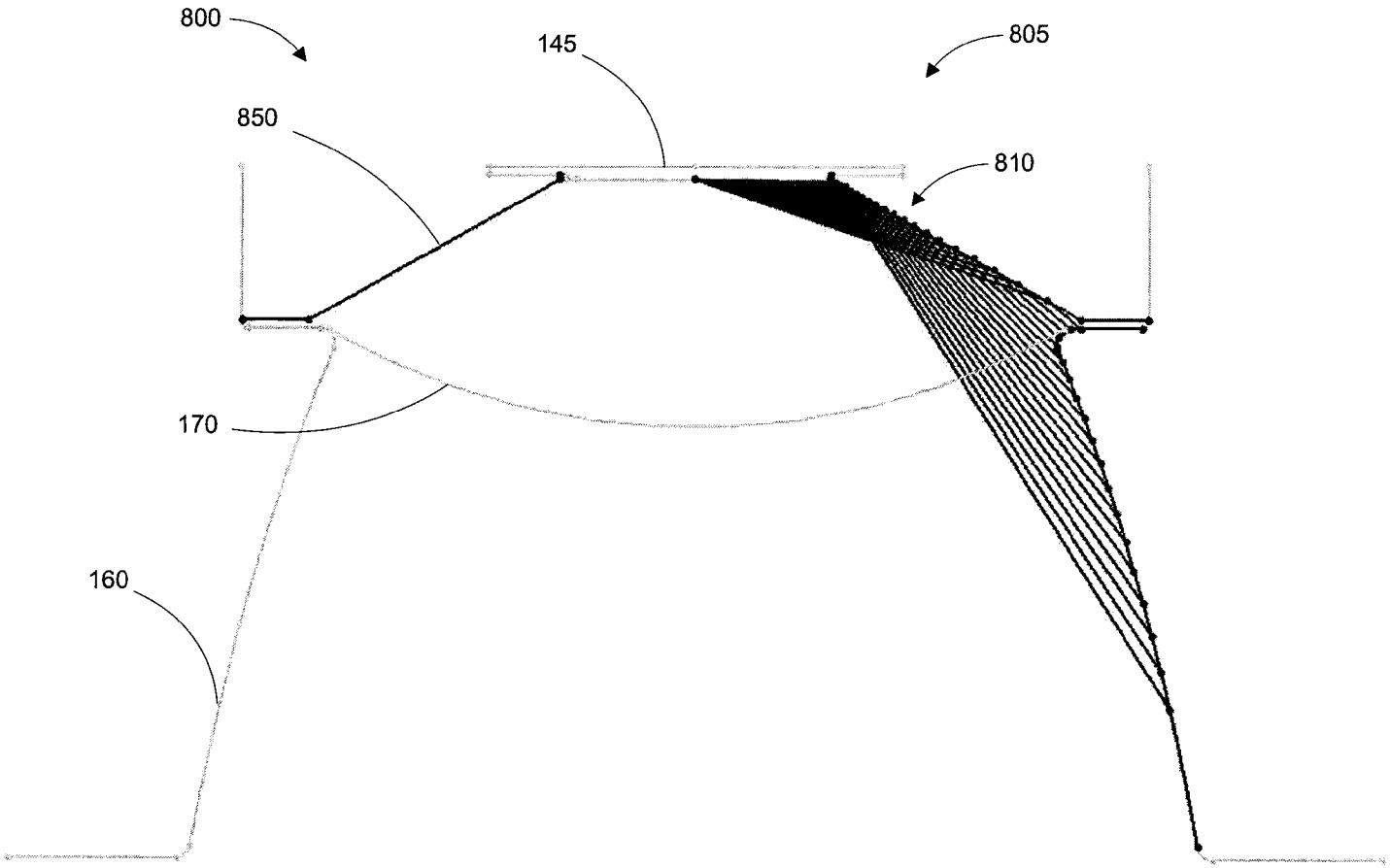
FIG. 8 depicts a raytrace for an LED downlight having an upper reflector with a substantially flat reflective surface, in accordance with certain exemplary embodiments.

FIGS. 7 and 8 illustrate a benefit of using an upper reflector 150 having a curved reflective surface rather than an upper reflector 850 having a substantially straight reflective surface. In particular, FIG. 7 depicts a raytrace 700 for the upper reflector 150 and FIG. 8 depicts a raytrace 800 for an LED downlight 805 having an upper reflector 850 with a substantially straight reflective surface. Referring to FIGS. 7 and 8, the raytrace 700 illustrates an outer edge of the light rays 710 emitted from the center of the LED light source 145. Similarly, the raytrace 800 illustrates an outer edge of the light rays 810 emitted from the center of the LED light source 145. For clarity, other light rays emitted by the LED light source 145, including those directed straight down from the LED light source 145, those directed to the other lateral side of the LED light source 145, and those in between the light rays 710, 810 and the center of the LED light source 145 are not illustrated in FIGS. 7 and 8.

The light rays 710 reflect off of the curved reflective profile of the upper reflector 150 and are directed towards the lens 170. Similarly, the light rays 810 reflect off of the straight profile of the upper reflector 850 and are directed towards the lens 170. By using the upper reflector 150 having a curved reflective profile, the light rays 710 are reflected by the upper reflector 150 in a direction closer to nadir than the light rays 810 reflected by the upper reflector 850. That is, the light rays 710 reflected by the upper reflector 150 are directed at a more downward angle than the light rays 810 reflected by the upper reflector 850. This more downward angle allows for a greater portion of the light rays 710 to pass through the lens 170 and exit an opening defined by the lower reflector 160 without reflecting off of the lower reflector 160 than the light rays 810. Because a large portion of the light rays 710 do not have to reflect off of the lower reflector 160 before exiting the LED downlight 100, the efficiency of the LED downlight 100 is increased. In contrast, all of the light rays 810 must reflect off of the lower reflector 850 before exiting the LED downlight 805, thus lowering the efficiency of the LED downlight 805.

Referring back to FIGS. 1 and 2, a portion of the upper reflector 150 along its periphery is disposed directly on the lens 170, thus making contact with the lens 170, in certain exemplary embodiments. This portion of the upper reflector 150 holds the lens 170 in place against the lower reflector 160. The lens 170 includes a circular or substantially circular outer perimeter 172 that extends out between a lower edge 153 of the upper reflector 150 along its perimeter and an upper edge 163 of the lower reflector 160 along it perimeter. In this position, the lower edge 153 and the upper edge 163 hold the lens 170 in place. In certain exemplary embodiments, the outer perimeter 172 of the lens 170 is attached to one or both of the lower edge 153 and the upper edge 163, for example using adhesives, screws, spring pressure, or another attachment device known to those of ordinary skill in the art having the benefit of the present disclosure. In one example, an adhesive is applied to a lower edge 153 of the upper reflector 150 and to an upper edge 163 of the lower reflector 160. The adhesive on the lower edge 153 of the upper reflector adheres to an upper surface of the outer perimeter 172 of the lens 170. Similarly, the adhesive on the upper edge 163 of the lower reflector 160 adheres to a lower surface of the outer perimeter 172 of the lens 170.

The LED lighting module 130 also includes a light leak prevention device 190. The light leak prevention device 190 prevents light from leaking out from the lens 170 along the outer perimeter 172 between the lower edge 153 of the upper reflector 150 and the upper edge 163 of the lower reflector 160. In one exemplary embodiment, the light leak prevention device 190 is disposed adjacent an outer edge of the outer perimeter 172 between the lower edge 153 and the upper edge 163. In certain exemplary embodiments, the light leak prevention device 190 runs circumferentially about the outer perimeter 172 of the lens 170. Examples of a light leak prevention device 190 include a gasket, a molded plastic ring, or other suitable device for blocking light. In certain exemplary embodiments, the light leak prevention device 190 is made from the same material as the upper reflector 150 or alternatively, of a material different than that of the upper reflector 150. In certain alternative embodiments, the outer perimeter 172 of the lens 170 is masked using paint or an L-shaped gasket to prevent light from exiting the lens 170 along its outer perimeter 172. In certain alternative embodiments, the lens 170 is co-injection molded with a black outer ring that serves as the outer perimeter 172 and prevents light from exiting the lens 170 along it outer perimeter 172.

Figure 5:
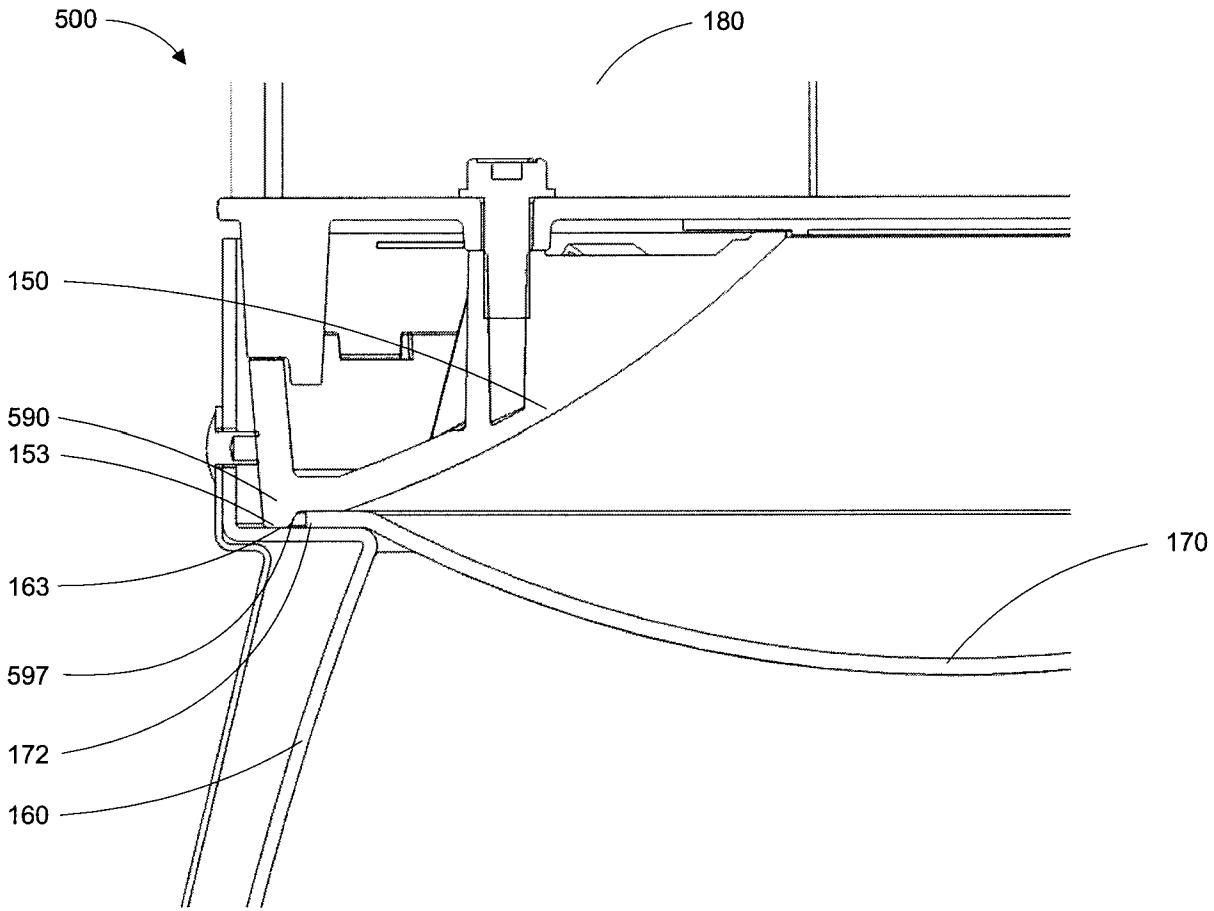
FIG. 5 is a cross-sectional view of a portion of an LED downlight having a light leak prevention device, in accordance with certain exemplary embodiments.

FIG. 5 is a cross-sectional view of a portion of an LED downlight 500 having an alternative light leak prevention device 590, in accordance with certain exemplary embodiments. Referring to FIG. 5, a light leak prevention flange 590 extends downward from an outer portion of the upper reflector 150. In this exemplary embodiment, the bottom edge 153 of the upper reflector 150 is disposed against or adjacent the upper edge 163 of the lower reflector 160. An inner edge 597 of the flange 590 is disposed against or proximal to the outer perimeter 172 of the lens 170. In certain exemplary embodiments, the flange 590 is made from the same material as the upper reflector 150 or alternatively, of a material different than that of the upper reflector 150. The exemplary flange 590 prevents light from leaking out from the lens 170 along the outer perimeter 172.

Figure 4:
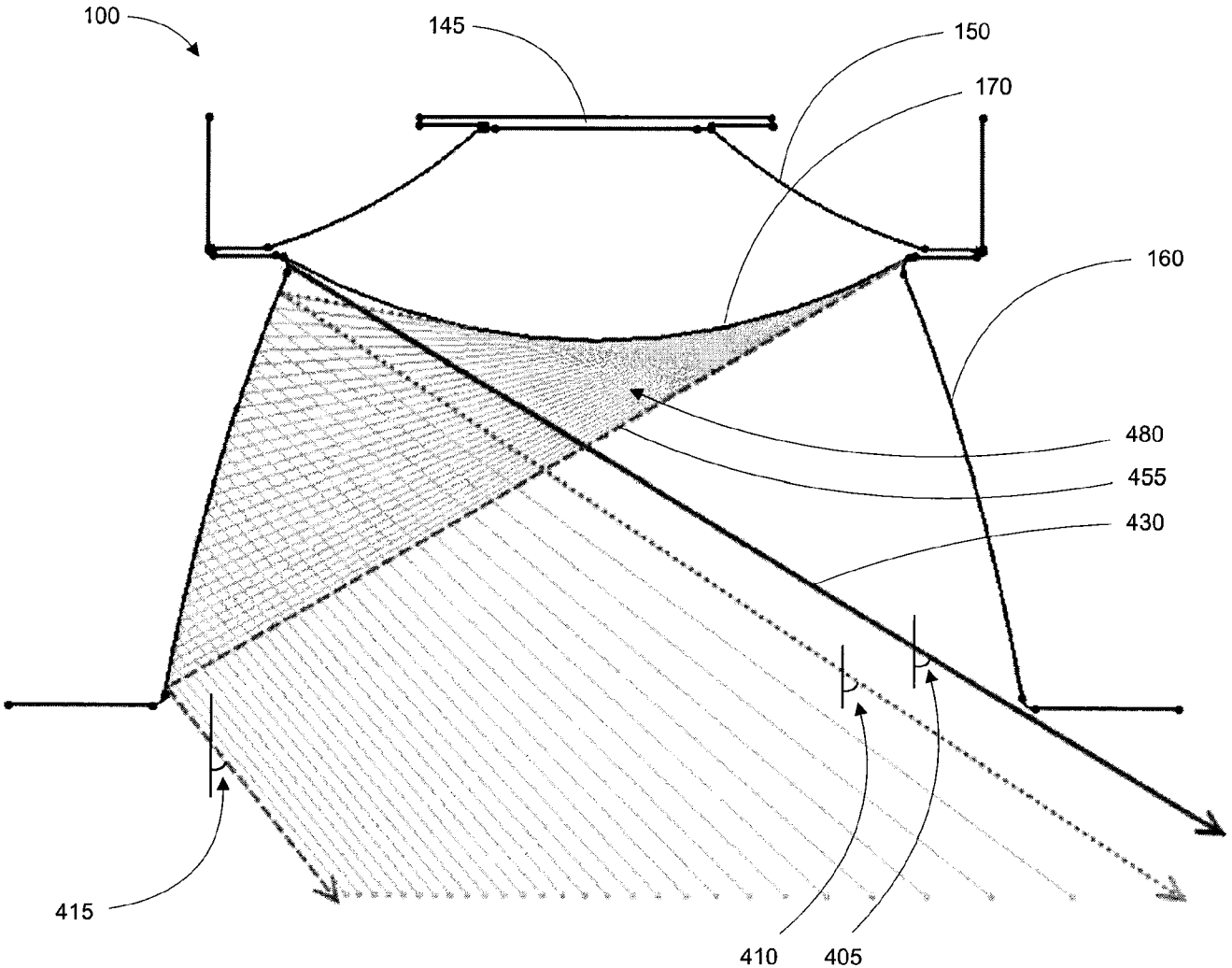
FIG. 4 depicts cutoff angles of the LED downlight of FIG. 1, in accordance with certain exemplary embodiments.

Referring back to FIGS. 1 and 2, the exemplary lower reflector 160 includes a parabolic reflector, such as a defocused parabolic reflector. In certain alternative embodiments, the lower reflector 160 is a truncated cone reflector, a frustum-shaped cone reflector, or other shaped reflector. The lower reflector 160 defines the physical cutoff of the LED downlight 100. FIG. 4 depicts cutoff angles 405-415 of the LED downlight 100, in accordance with certain exemplary embodiments. Referring to FIG. 4, the exemplary LED downlight 100 has a physical cutoff angle 405 of 60°, an aiming cutoff angle 410 of 56°, and an aiming lower angle 415 of 40°. Each of the aforementioned angles 405-415 are defined by the shape of the lower reflector 160 and the provided values for the angles 405-415 are exemplary rather than limiting. The physical cutoff angle 405 is the angle between nadir and a line 430 that first conceals the direct view of the lens 170 which behaves like a secondary source. This line 430 runs from the top interior point on one side of the lower reflector 160 to the bottom interior point of the lower reflector 160 on a side of the lower reflector 160 opposite the one side. For a lower reflector 160 having a circular top perimeter and a circular bottom perimeter, the line 430 would run from a point on the circular top perimeter to a point on the circular bottom perimeter opposite (180 offset) from the point on the circular top perimeter.

The aiming cutoff angle 410 and the aiming lower angle 415 are angles used to design the lower reflector 160. The aiming cutoff angle 410 is the highest angle at which the top of the lower reflector 160 (for a top to bottom reflector flash) reflects light from either the primary source (directly from the LED light source 145 through the lens 170) or from a secondary source (light reflected by the lens 170 and lower reflector 150). The aiming lower angle 415 is the highest angle at which the bottom of the lower reflector 160 reflects light from either the primary source or the secondary source.

Referring back to FIGS. 1 and 2, the LED lighting module 130 includes a cone vertical slot 147 disposed on either side of the light source housing 140. The cone vertical slots 147 adjust vertically to allow the LED lighting module 130 to accommodate a multitude of lens thicknesses. That is, the cone vertical slots 147 are adjustable vertically based on the thickness of the lens 170. The cone vertical slots 147 also allow the upper reflector 150 to rest on the lens 170 and maintain the same optical control for multiple lens sizes, shapes, and thicknesses.

The lens 170 includes several features that together disperse the light emitted by the LED light source 145, providing a more uniform light output from the LED downlight 100. In one exemplary embodiment, the lens 170 includes a translucent or a transparent lens having a diffusion element. The diffusion element diffuses light emitted by the LED light source 145 in a manner know to those of ordinary skill in the art. In certain exemplary embodiments, the diffusion element is a pigment, a prismatic diffuser, inlays, or bulk scattering. However, those of ordinary skill in the art will recognize that other known methods for diffusing light through a lens 170 can be substituted without departing from the scope and spirit of the present invention.

In certain exemplary embodiments, the lens 170 is curved in a concave manner when viewed from the LED light source 145. Providing a concave curved lens 170 adds distance between the LED light source 145 and all points on the lens 170. However, the maximum increase in distance occurs at the point directly under the LED light source 145 where the added distance is needed most. The increase in distance is less for all points approaching the outer portion of the lens 170. A concave curved lens 170 also reduces the angle of incidence for the points on the lens 170 that are not directly under the LED light source 145. As compared to flat lenses, the more space there is between the LED light source 145 and the lens 170, the more evenly luminous the lens 170 will appear as light is passing through the lens 170. The reason a curved lens 170 will appear more uniformly luminous is because the illuminance created on the inside surface 175 of the curved lens 170 is more uniform than of that created on a flat-shaped lens. This increase in uniformity is can be explained using the formula for illuminance provided in Equation 1.

$$\text{Illuminance(or light level)}=\text{Intensity}\times\text{Cos(Angle of Incidence)}/\text{Distance}^2. \qquad \text{Equation 1}$$

Based on Equation 1, the light level at a point on the lens 170 is dependent on the intensity of the light incident on that point, the angle of incidence at that point, and the distance between the LED light source 145 and that point. In the case of a downward facing LED light source 145, the light distribution is relatively lambertain, meaning that the maximum intensity of light emitted by the LED light source 145 is facing directly downward, and it drops off by a cosine factor as the angle approaches horizontal. To reduce the difference in light level at different points on the lens 170 caused by this difference in intensity, the curved lens 170 adds additional distances between the LED light source 145 and the points on the lens 170 receiving higher intensity light from the LED light source 145, namely the portion of the lens 170 directly below the LED light source 145 and portions of the lens 170 close thereto. This additional increase in distance reduces the light level for the portions of the lens 170 directly below the LED light source 145 (and points close thereto) compared to the light level at points on the lens 170 not directly below the LED light source 145.

The curved lens 170 also decreases the angle of incidence for all points on the lens 170 not directly below the LED light source 145. This decrease in angle of incidence increases the Cos(Angle of Incidence) and thus, the light level at those points. The decrease in angle of incidence is greater for points on the lens 170 further from the point directly below the LED light source 145. This further increases the light level at the points not directly under the LED light source 145 compared to the light level at the portion of the lens 170 directly under the LED light source 145.

Figure 6:
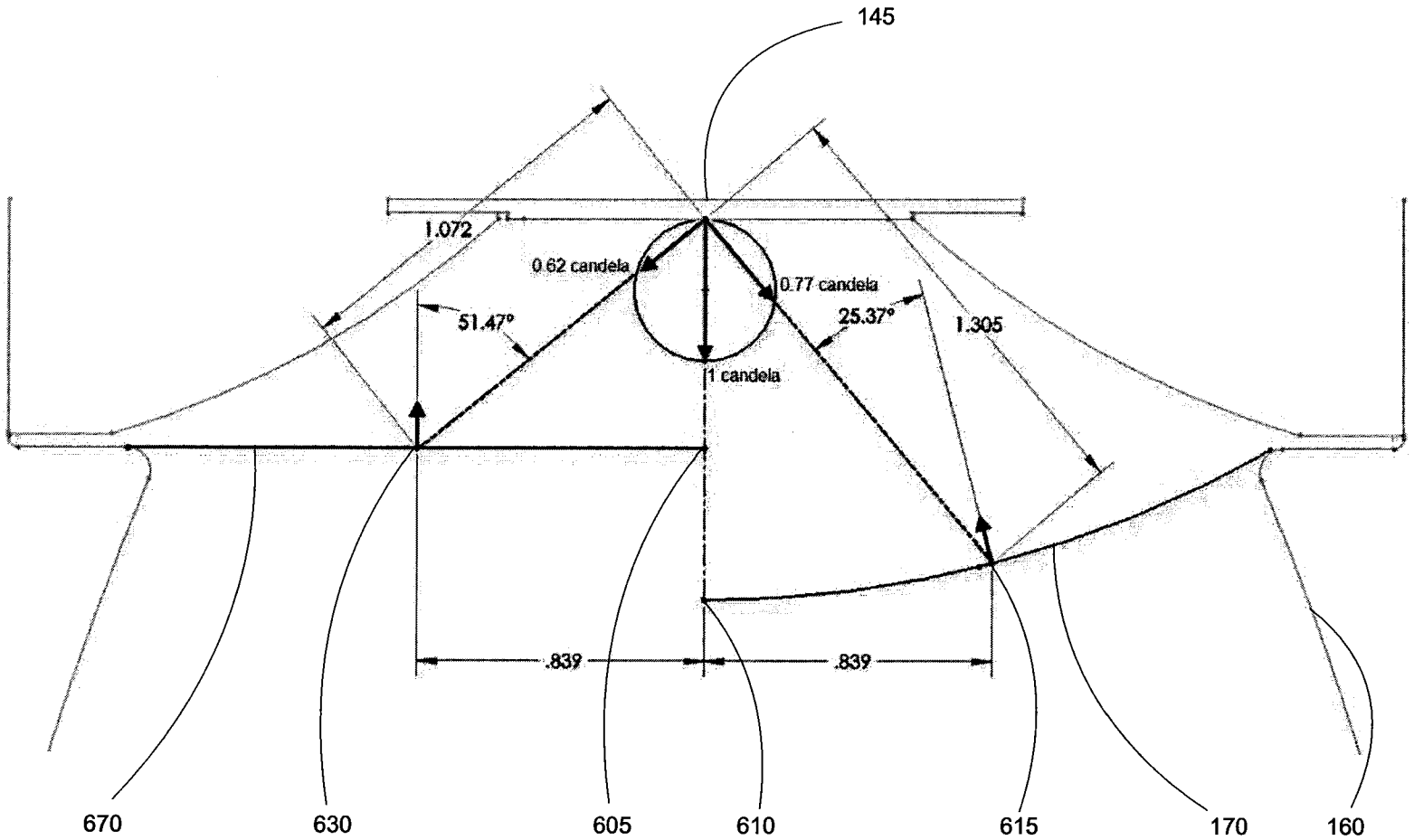
FIG. 6 depicts a comparison of light output achieved by a curved lens and light output achieved by a flat-shaped lens, in accordance with certain exemplary embodiments.

FIG. 6 depicts the light level achieved by the curved lens 170 as compared to light level achieved by a flat-shaped lens 670, in accordance with certain exemplary embodiments. Referring to FIG. 6, the curved lens 670 provides a light level of 0.406 foot-candles ("fc") at a point 615 spaced laterally 0.839 inches from the center 610 of the lens 170. In comparison, the flat-shaped lens 670 provides a light level of 0.337 fc at a point 630 spaced laterally 0.839 inches from the center 605 of the lens 670. This difference in light output is due to a larger intensity value for the point 615 compared to the intensity value for the point 630 and a decreased angle of incidence for the point 615 compared to the angle of incidence for the point 630. In particular, the point 615 on the lens 170 receives higher intensity light output (0.77 cd) from the LED light source 145 than the intensity of light output for point 630 (0.62 cd) because the point 615 is disposed at a smaller angle with respect to the direction of illumination for the LED light source 145, namely straight down. Also, the angle of incidence for the point 615 is 25.36° while the angle of incidence for the point 630 is 51.47°. The lower angle of incidence results in a higher light level as provided by Equation 1.

Referring back to FIG. 4, in one exemplary embodiment, to maximize or improve the visual effect of a more uniformly luminous lens 170, the curve of the lens 170 is at an arc having a portion of the arc tangent to the physical cutoff line 430 of the lower reflector 160. In certain exemplary embodiments, the perimeter of the lens 170 is tangent to the physical cutoff line 430. By providing an arc-shaped lens 170 that is includes a portion tangent to the physical cutoff line 430 of the lower reflector 160, a benefit is derived in that a curved lens 170 is employable in the LED downlight 100 without occluding any portion of the lower reflector 160 or changing the cutoff angle of the LED downlight 100. In certain exemplary embodiments, the lens 170 is configured such that the physical cutoff line 430 of the lower reflector 160 is tangent to at least a portion of the lens surface. In certain exemplary embodiments, the curve of the lens 170 can be substantially anywhere within an area 480 defined by the physical cutoff line 430 and a line 455 perpendicular to the physical cutoff line 430 and maintain the benefits of an evenly luminous lens 170.

While the exemplary embodiments illustrate and describe the curvature of the lens 170 being an arc, those of ordinary skill in the art will recognize that other curved lens shapes can be substituted for the arc-shaped lens 170 including, but not limited to, a spline, an ellipse, or a cone, such that the curve of the lens 170 does not occlude the lower reflector 160 from the observer's view. Another benefit to the curved lens 170 is that the curved lens 170 has a higher transmission of light directly incident on the curved lens 170 from the LED light source 145, because the light's angle of incidence to the curved lens 170 is closer to the lens' normal vector (at that particular point) than that for a flat-shaped lens.

One of ordinary skill in the art would appreciate that the present inventions provides an LED downlight having improved light output. Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light emitting diode ("LED") downlight, comprising:

an LED light source;

an upper reflector that is disposed about a perimeter of the LED light source and that bows inward while extending in a curvilinear manner downward to a bottom edge from the LED light source;

a lower reflector disposed below the upper reflector; and a lens disposed between the upper reflector and the lower reflector and comprising an outer perimeter and a curved surface disposed within the outer perimeter, the curved surface comprising a vertex disposed substantially in front of the LED light source, wherein the lower reflector and the curved surface are oriented such that:

a first ray following a first tangent of the curved surface exits the downlight after exactly one reflection by the lower reflector, the first tangent taken at the vertex; and a second ray following a second tangent of the curved surface exits the downlight after exactly one reflection by the lower reflector, the second tangent taken at the outer perimeter in a direction extending in front of the vertex.

2. The LED downlight of claim 1, wherein the lens comprises a diffusion element.

3. The LED downlight of claim 1, wherein the upper reflector comprises a diffusely reflective surface.

4. The LED downlight of claim 1, wherein the curvature of the curved surface is concave to the LED light source.

5. The LED downlight of claim 1, wherein the LED light source comprises one of an LED, an LED package, and an LED chip on board module.

6. The LED downlight of claim 1, wherein the upper reflector forms a mixing cavity.

7. The LED downlight of claim 1, wherein the upper reflector comprises a white reflective surface, and wherein the lower reflector defines a physical cutoff of the LED downlight that is an angle between nadir and a line that first conceals direct view of the lens.

8. The LED downlight of claim 1, wherein the outer perimeter of the lens is disposed adjacent to the bottom edge of the upper reflector between portions of the upper reflector and the lower reflector.

9. The LED downlight of claim 8, further comprising a light leak prevention flange extending downward from an outer portion of the upper reflector, wherein a bottom edge of the flange is disposed against the lower reflector and an inner edge of the flange is disposed adjacent to an outside edge of the outer perimeter of the lens.

10. The LED downlight of claim 8, further comprising a light leak prevention device disposed along an outside edge of the outer perimeter of the lens and comprising a top surface disposed adjacent an outer portion of the upper reflector and a lower surface disposed adjacent a portion of the lower reflector adjacent the outer perimeter of the lens.

11. The LED downlight of claim 1, wherein the curved surface comprises a peripheral surface region adjacent the outer perimeter, and wherein all tangents on the peripheral surface region intersect the lower reflector.

12. The LED downlight of claim 1, wherein the curvature of the lens is tangent to a physical cutoff of the lower reflector, the physical cutoff being defined by a line that extends from a point on a top perimeter of the lower reflector to a point on a bottom perimeter of the lower reflector, the point on the top perimeter and the point on the bottom perimeter being on opposite sides of the lower reflector.

13. The LED downlight of claim 1, wherein a surface of the lens is disposed adjacent a line defining a physical cutoff of the lower reflector, the physical cutoff being defined by a line that extends from a point on a top perimeter of the lower reflector to a point on a bottom perimeter of the lower reflector, the point on the top perimeter and the point on the bottom perimeter being on opposite sides of the lower reflector.

14. The LED downlight of claim 1, wherein the vertex of the lens is disposed substantially above a line defining a physical cutoff of the lower reflector, the physical cutoff being defined by a line that extends from a point on a top perimeter of the lower reflector to a point on a bottom perimeter of the lower reflector, the point on the top perimeter and the point on the bottom perimeter being on opposite sides of the lower reflector.

15. A light fixture, comprising:

a light source;

an upper reflector disposed about a lateral edge of the light source and comprising a convex reflective surface that extends in a curvilinear manner downward to a bottom edge from the light source;

a lower reflector disposed below the upper reflector;

a lens having at least a portion disposed between the upper reflector and the lower reflector, the lens comprising:

an outer, perimeter disposed between portions of the upper reflector and the lower reflector; and a surface that faces away from the light source, the surface following a curve extending between the outer perimeter and a central portion of the lens, wherein each tangent of the curve is oriented for exiting the light fixture after exactly one reflection by the lower reflector; and a light leak prevention device disposed along an outside of the outer perimeter of the lens for preventing light emitted by, the light source from exiting the lens through the outer perimeter.

16. The light fixture of claim 15, wherein the light leak prevention device comprises a light leak prevention flange extending downward from an outer portion of the upper reflector, wherein a bottom edge of the flange is disposed against the lower reflector and an inner edge of the flange is disposed adjacent to an outside of the outer perimeter of the lens.

17. The light fixture of claim 15, wherein the light leak prevention device comprises a top surface disposed adjacent an outer portion of the upper reflector and a lower surface disposed adjacent a portion of the lower reflector adjacent the outer perimeter of the lens, wherein the lens comprises a first side facing towards the light source and a second side facing away from the light source, and wherein any tangent taken at any location of the second side that is within the outer perimeter intersects the lower reflector.

18. The light fixture of claim 17, wherein the upper reflector defines a mixing cavity.

19. A downlight luminaire, comprising:

an LED light source;

an upper reflector disposed circumferentially about the LED light source and extending in a curvilinear manner downward to a bottom edge from the LED light source, the upper reflector comprising a reflective surface that is convex to the LED light source;

a lower reflector disposed below the upper reflector and comprising a substantially conical shape; and a lens disposed between the upper reflector and the lower reflector and comprising:

a circular outer perimeter;

a curved shape concave to the LED light source; and a diffusion element, wherein a portion of the curvature of the lens is tangent to a physical cutoff of the lower reflector, the physical cutoff being defined by a line that extends from a point on a top perimeter of the lower reflector to a point on a bottom perimeter of the lower reflector, the point on the top perimeter and the point on the bottom perimeter being on opposite sides of the lower reflector, and wherein at each increment of the curved shape. a tangent ray is oriented for exiting the downlight luminaire after a single reflection by the lower reflector.

20. The downlight luminaire of claim 19, wherein the curvature of the lens comprises an arc, a spline, an ellipse, or a cone.

21. The downlight luminaire of claim 19, wherein the upper reflector acts as a mixing cavity.

22. The downlight luminaire of claim 19, wherein the reflective surface is diffusely reflective.

23. The downlight luminaire of claim 19, wherein the reflective surface is white.

24. The downlight luminaire of claim 19, wherein the outer perimeter of the lens is circular and disposed adjacent to the bottom edge of the upper reflector, and wherein the outer perimeter is disposed between portions of the upper reflector and the lower reflector.

25. The downlight luminaire of claim 19, further comprising a light leak prevention flange extending downward from an outer portion of the upper reflector, wherein a bottom edge of the flange is disposed against the lower reflector and an inner edge of the flange is disposed adjacent to an outside of the outer perimeter of the lens.

26. The downlight luminaire of claim 19, further comprising a light leak prevention device disposed along an outside of the outer perimeter of the lens and comprising a top surface disposed adjacent an outer portion of the upper reflector and a lower surface disposed adjacent a portion of the lower reflector adjacent the outer perimeter of the lens.

* * * * *